United States Patent [19]

Wiessner

[11] 4,390,757

[45] Jun. 28, 1983

[54] CODING SWITCH

[75] Inventor: Edgar Wiessner, Amberg, Fed. Rep. of Germany

[73] Assignee: Siemens Aktiengesellschaft, Munich, Fed. Rep. of Germany

[21] Appl. No.: 311,415

[22] Filed: Oct. 14, 1981

[30] Foreign Application Priority Data

Oct. 28, 1980 [DE] Fed. Rep. of Germany ..... 3040546

[51] Int. Cl.[3] ..... H01H 19/14

[52] U.S. Cl. ..... 200/11 G; 200/155 R; 200/283; 200/292

[58] Field of Search ..... 200/11 R, 11 A, 11 B, 200/11 C, 11 D, 11 DA, 11 E, 11 EA, 11 G, 11 H, 11 J, 11 K, 7 C, 7 TW, 252, 238, 292, 45, 155 R, 43, 283

[56] References Cited

U.S. PATENT DOCUMENTS

| | | | |
|---|---|---|---|
| 1,315,306 | 9/1919 | Hojgaard | 200/43 |
| 1,603,093 | 12/1926 | Noonan | 200/11 K |
| 2,742,537 | 4/1956 | Leslie | 200/11 K X |
| 3,213,216 | 10/1965 | Beck | 200/11 C X |
| 3,566,049 | 2/1971 | Wright | 200/11 TW X |
| 3,579,257 | 5/1971 | Spreitzer | 200/292 X |

FOREIGN PATENT DOCUMENTS 1245622 7/1967 Fed. Rep. of Germany .

*Primary Examiner*—R. L. Moses
*Assistant Examiner*—Morris Ginsburg
*Attorney, Agent, or Firm*—Kenyon & Kenyon

[57] ABSTRACT

Disclosed is a coding switch comprising at least two conductor paths each having a plurality of contact points disposed on a circuit board about at least a portion of a circle, the circles about at least a portion of which the contact points of the respective paths are disposed being coaxial, and a wiper having at least two spaced and electrically connected contact points secured to the circuit board to rotate about the center of the coaxial circles so that each contact point of the wiper can come into electrical contact with the contact points of a respective conductor path. The wiper is preferably provided with a handle at an end thereof outwardly of the center of the coaxial circles for manually rotating the wiper. The wiper can be set without setting apparatus such as setting rings and the like and the handle can be moved, even from a distance, by a pencil, for example.

11 Claims, 3 Drawing Figures

CODING SWITCH

BACKGROUND OF THE INVENTION

The present invention relates to a coding switch having several conductors which can be bridged by a wiper.

DE-AS No. 1,245,622 discloses a coding switch in which the contact points of several conductors are arranged along a single circular or ring path, for example on a printed circuit, swept by a single sliding contact. The coding switch disclosed in this German patent publication has a complicated current lead-in configuration. It also has the disadvantage that predetermined contact points which are to be bridged are juxtaposed circumferentally extending along the ring path and are bridged by a single wiper contact, which can result in poor electrical contact.

OBJECTS AND SUMMARY OF THE INVENTION

It is an object of the present invention to provide an improved coding switch having several conductors bridged by a wiper.

It is another object of the present invention to provide an improved coding switch having several conductors bridged by a wiper which has improved contact characteristics and which is yet simple and compact.

It is another object of the present invention to provide a coding switch having several conductors bridged by a wiper which can be activated without additional driving means for the wiper.

These and other objects are achieved in accordance with the invention, by providing a coding switch in which the contact points of conductors or conductor paths are located along portions of coaxial circular rings and a wiper is provided with spaced contact points which make contact with the contact points of respective conductor paths.

The invention provides a coding switch comprising at least two conductor paths each having a plurality of contact points disposed about at least a portion of a circle, the circles about at least a portion of which the contact points of the respective conductor paths are disposed being coaxial, and a wiper having at least two spaced and electrically connected contact points secured to rotate about the center of the coaxial circles so that each contact point of the wiper can come into electrical contact with the contact points of a respective conductor path.

The wiper is preferably provided with a handle at an end thereof outwardly of the center of the coaxial circles so that the wiper can be manually rotated. The handle may be produced in the form of a projection or bulge which an instrument such as a pencil can engage to rotate the wiper, even at a distance from the coding switch.

The conductor paths can be disposed on a circuit board, e.g. a printed circuit board, and the wiper rotatably secured to the circuit board.

Means can be provided in accordance with one aspect of the invention for adjustably setting the wiper. Such means according to a disclosed embodiment can comprise a detent hump provided in the vicinity of the handle and holes or dimples in the circuit board into which the detent hump snaps. The detent arrangement can prevent unintentional shifting of the wiper from the position it is set in. The detent hump can be formed by a bent and rounded end of the wiper.

According to a disclosed embodiment, the contact points of the at least two conductor paths are arranged about adjacent portions of the coaxial circles and the coding switch includes at least two additional conductor paths each having a plurality of contact points disposed about different adjacent portions of the coaxial circles. An additional wiper having at least two spaced and electrically connected contact points is secured to rotate about the center of the coaxial circles so that each contact point of the additional wiper can come into electrical contact with the contact points of a respective additional conductor path. The contact points of the wiper and the additional wiper in this embodiment are electrically connected to form a two decade switch.

According to an aspect of the invention, each wiper can be comb-like having offset comb tines whose ends form the contact points and a web which is rotatably connected to the circuit board at the center of the coaxial circles. The web of each wiper is offset from the contact points. Each wiper can be a copper berillium stamped part. Providing the wiper in finger form makes it possible to achieve a desired contact pressure for the contact points of individual conductor paths.

In order to be able to accommodate a two decade coding switch in practically the same space as for a single decade switch, the conductor paths to be bridged can be arranged on semicircular rings, as described above, and two electrically connected together wipers can be rotatably connected to the center of the circles. With the wipers provided in comb form with offset comb tines whose ends form the contact points, and with the center of rotation of the wipers located in a web portion extended from the web in comb-tine fashion, the web extension portion advantageously being offset as well as the web itself, the two wipers can be in adjacent positions overlapping each other, i.e. one wiper may be in the "0" position and the other in position "9", without losing contact points on the circle.

The above and other aspects, features, advantages and objects of the invention will be more apparent from the following description of the preferred embodiment thereof when considered with the accompanying drawings and appended claims.

DESCRIPTION OF THE PREFERRED EMBODIMENT

Figure 1:
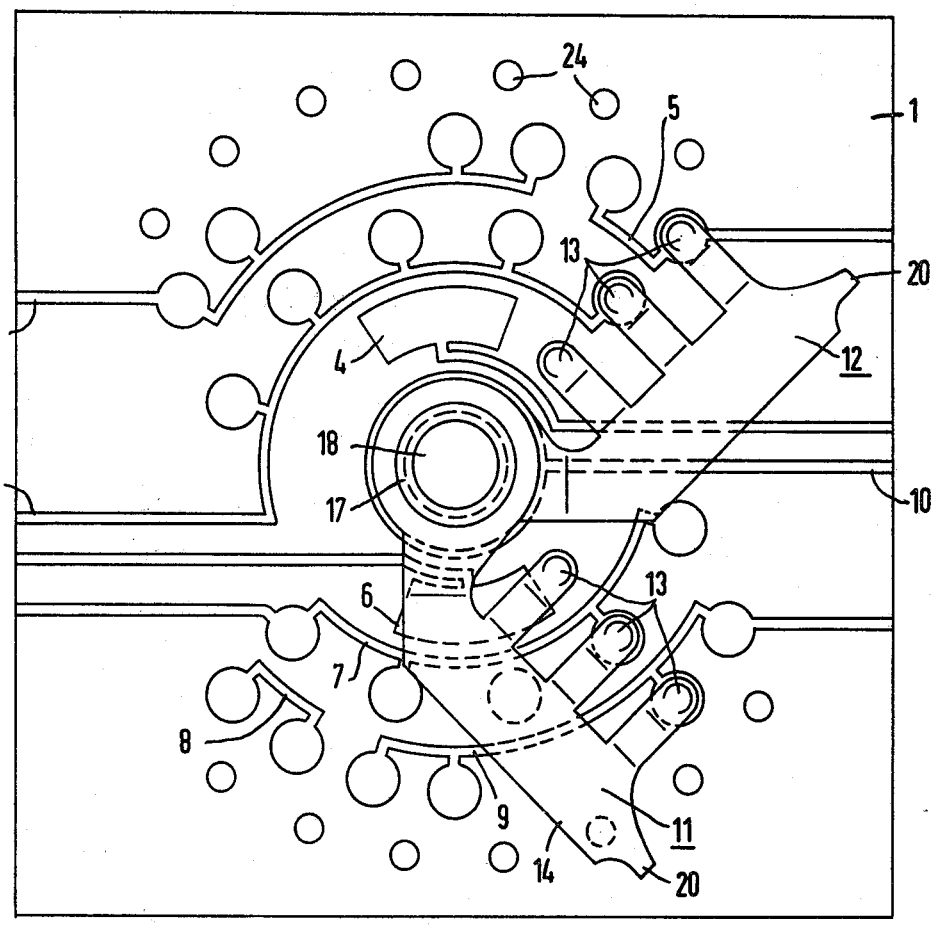
FIG. 1 is a plan view of a part of a circuit board provided with conductor paths and wipers according to the invention.

Referring more particularly now to the drawings, an embodiment of a coding switch according to the invention is illustrated. The coding switch comprises conductor paths 2, 3, 4, 5, 6, 7, 8, and 9 disposed on a circuit board 1 in the form of a printed circuit. The circuit board 1 may be part of an existing relay circuit board. A conductor path 10 is provided on the circuit board 1 as a lead to wipers 11 and 12.

The contact points of conductor paths 2 and 5 are located along a portion of one circle, the contact point of conductor path 3 is located along a portion of another circle, and the contact point of conductor path 4 is located along a portion of still another circle. The three circles along portions of which the contact points of conductor paths 2–5 are located are coaxially arranged.

The contact points of conductor paths 8 and 9 are located along a portion of one circle, the contact point of conductor path 7 is located along a portion of another circle, and the contact point of conductor path 6 is located along a portion of still another circle. The three circles along portions of which the contact points of conductor paths 6–9 are located are also coaxially arranged.

As shown in FIG. 1, the conductor paths themselves are also disposed about portions of respective coaxial circles.

Preferably, the contact points of conductor paths 2, 5, 8 and 9 are located about the same circle, the contact points of conductor paths 3 and 7 are located about the same circle, and the contact points of conductor paths 4 and 6 are located about the same circle, all circles being coaxial with the circular lead-in conductor path 10.

As shown in FIG. 1, conductor paths 2–5 and their contact points are located on one side of the circuit board and conductor paths 6–9 and their contact points are located on the other side of the circuit board 1, so that two identical wipers 11 and 12 can be used to make contact with the separate contact points of the conductor paths.

The wipers 11 and 12 are provided with fingers 13, three being provided in the illustrated embodiment. The wipers are comb-like with the fingers forming comb tines which are connected by a web 14. A tubular rivet is inserted through an opening 15 in an angled web extension 16 of both wipers and through a center hole 18 in the circuit board 1 to rotatably attach the wipers 11 and 12 to the circuit board. To provide a good contact, the wiper portion 19 surrounding the opening 15 may advantageously be corrugated. The web extension 16 as well as the fingers 13 themselves are offset so that the web 14 of one wiper can extend over the contact points of the other wiper when the wipers are in adjacent positions without thereby closing contacts.

Figure 2:
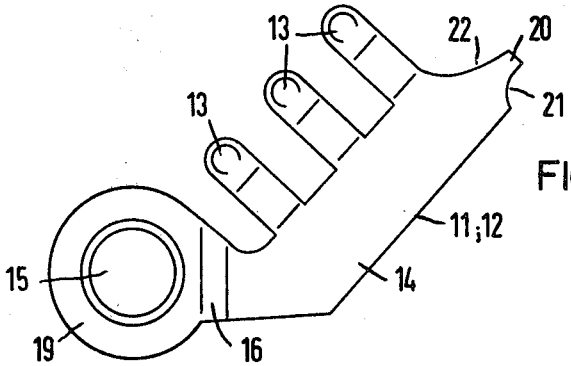
FIG. 2 is an enlarged plan view of one of the wipers of FIG. 1.

As shown in FIG. 2, web 14 ends in a handle 20 formed by cutouts 21, 22. The cutout 22 also enables numbers associated with the conductor paths to be read. The handle 20 can be produced without extra cost by providing the cutouts when punching out the wiper.

Figure 3:
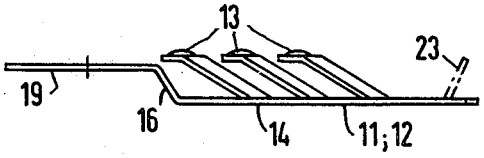
FIG. 3 is an enlarged elevation view of the wiper of FIG. 2.

To lock the wiper in a respective position, the free end of the wiper forming the handle 20 can advantageously be rounded and bent as shown in FIG. 3 in broken lines so that a flexible tab 23 forms a detent hump which can snap into detent holes or dimples 24 (FIG. 1) circularly arranged in the circuit board 1. The circularly arranged detent holes 24 can be made by an automatic drill press operation during production of the circuit board without introducing significant extra costs.

The coding switch according to the invention is extremely inexpensive and is suited in particular for small configurations and occasional resetting. The coding switch has an area such that it can be practically integrated in a printed circuit and can be made with or without detents. The coding switch illustrated provides two decades on one surface and can be operated, and settings recognized, from one side.

The advantages of the present invention, as well as certain changes and modifications of the disclosed embodiment thereof, will be readily apparent to those skilled in the art. It is the applicant's intention to cover by his claims all those changes and modifications which would be made to the embodiment of the invention herein chosen for the disclosure without departing from the spirit and scope of the invention.

What is claimed is:

1. A coding switch comprising at least two conductor paths each having a plurality of contact points disposed about at least a portion of a circle, circles about at least a portion of which the contact points of the respective conductor paths are disposed being coaxial, and an elongated wiper rotatably secured at one end thereof at the center of the coaxial circles and extending radially therefrom, the wiper having at least two electrically connected contact points spaced along said wiper so as to be radially spaced with respect to the coaxial circles, the wiper having a handle disposed at an end thereof radially spaced from said one end by means of which the wiper can be rotated about the center of the coaxial circles so that each contact point of the wiper can come into electrical contact with the contact points of a respective conductor path as the wiper is rotated.

2. The coding switch according to claim 1 wherein the conductor paths are disposed on a circuit board and the wiper is rotatably secured to the circuit board, the wiper having a detent hump provided in the vicinity of the handle, and the circuit board having holes into which the detent hump can snap.

3. The coding switch according to claim 1 wherein the contact points of the at least two conductor paths are arranged about adjacent portions of the coaxial circles, the coding switch including at least two additional conductor paths each having a plurality of contact points disposed about different adjacent portions of said coaxial circles, and an additional elongated wiper rotatably secured at one end thereof at the center of the coaxial circles and extending radially therefrom, the wiper having at least two electrically connected contact points spaced along said wiper so as to be radially spaced with respect to the coaxial circles, the additional wiper having a handle disposed at an end thereof radially spaced from said one end by means of which the additional wiper can be rotated about the center of said coaxial circles so that each contact point of the additional wiper can come into electrical contact with the contact points of a respective additional conductor path as the additional wiper is rotated.

4. The coding switch according to claim 3 wherein the conductor paths are disposed on a circuit board and each wiper is rotatably secured to the circuit board, each wiper having a detent hump provided in the vicinity of the respective handle, and the circuit board having holes into which the respective detent humps can snap.

5. The coding switch according to claim 3 or 4, wherein the contact points of the wiper and the additional wiper are electrically connected together to form a two decade switch.

6. The coding switch according to claim 4 wherein each wiper is comb-like having offset comb tines whose ends form the contact points of the wiper and a web which is rotatably connected to the circuit board at the center of said coaxial circles.

7. The coding switch according to claim 6 wherein the web of each wiper is offset from the contact points.

8. The coding switch according to claim 6 wherein each wiper is a copper berillium stamped part.

9. The coding switch according to claim 2 wherein the wiper is comb-like having offset comb tines whose ends form the contact points of the wiper and a web which is rotatably connected to the circuit board at the center of said coaxial circles.

10. The coding switch according to claim 2 wherein the web of the wiper is offset from the contact points.

11. The coding switch according to claim 2 wherein the wiper is a coper berillium stamped part.

* * * * *